US010897981B2

(12) United States Patent
Chen

(10) Patent No.: US 10,897,981 B2
(45) **Date of Patent: *Jan. 26, 2021**

(54) COLLAPSIBLE CONTAINER WITH STRAW

(71) Applicant: Arianna Chen, Milford, CT (US)

(72) Inventor: Arianna Chen, Milford, CT (US)

( * ) Notice: Subject to any disclaimer, the term of this patent is extended or adjusted under 35 U.S.C. 154(b) by 137 days.

This patent is subject to a terminal disclaimer.

(21) Appl. No.: 16/195,905

(22) Filed: Nov. 20, 2018

(65) Prior Publication Data

US 2019/0082815 A1 Mar. 21, 2019

Related U.S. Application Data

(62) Division of application No. 14/262,908, filed on Apr. 28, 2014, now Pat. No. 10,165,849.

(51) Int. Cl.
*A45F 3/20* (2006.01)
*A47G 19/22* (2006.01)

(52) U.S. Cl.
CPC ..... *A45F 3/20* (2013.01); *A47G 19/2266* (2013.01); *A47G 2019/2277* (2013.01)

(58) Field of Classification Search
CPC ..... A45F 2003/205; A45F 3/16; A45F 3/20; A47G 19/2222; A47G 19/2266; A47G 19/2272; A47G 2019/2277; A47G 21/18; B65D 21/086; B65D 77/283; B65D 77/286
USPC ..... 215/900; 220/666, 703, 705, 707, 709, 220/710
See application file for complete search history.

(56) References Cited

U.S. PATENT DOCUMENTS 6,499,614 B1 * 12/2002 Thompson ..... B65D 1/04 215/388

* cited by examiner

*Primary Examiner* — James N Smalley
*Assistant Examiner* — Madison L Poos
(74) *Attorney, Agent, or Firm* — IP Attorneys Group, LLC

(57) ABSTRACT

A collapsible, reusable drinking container is provided having a first opening suitable for pouring and filling, a second opening for accessing the interior of the container for cleaning, and a flexible straw for drinking the contents while the container is held in an upright position. The first opening is reversibly sealed with a cap, the second opening with an interlocking ridge and groove fastener, and the straw is reversibly sealed using a plug, a cap, a push-pull cap, a reversibly discontinuous portion of the straw, or an element for reversibly kinking the straw. The straw is attached to the container wall, to the cap for sealing the first opening, or to the fastener for sealing the second opening.

20 Claims, 8 Drawing Sheets

COLLAPSIBLE CONTAINER WITH STRAW

CROSS REFERENCE TO CO-PENDING APPLICATIONS

This application is a divisional of and claims priority to U.S. application Ser. No. 14/262,908 filed on Mar. 28, 2014 and titled "Collapsible Container with Straw." The contents of the above-referenced application is relied upon and incorporated herein by reference in its entirety.

FIELD OF THE INVENTION

This invention relates to collapsible, reusable drinking containers, and particularly to a collapsible container having an integral straw, an opening suitable for pouring liquids sealed with a removable cap, and an opening for accessing the interior of the container sealed with an interlocking ridge and groove fastener.

BACKGROUND OF THE INVENTION

Reusable drinking containers that can be sealed for traveling or storage are well known in the art, and are frequently used for carrying liquids for sporting activities such as bicycling, hiking, boating and camping. Such containers are increasingly used by spectators of sporting events, families with small children, and in fact by anyone who desires to keep drinkable beverages handy. For these types of activities, it is desirable to be able to drink directly from the container, as the provision of a separate cup provides additional complications of storage of the cups, transfer of the liquid from the container to the cup, and either disposal of the cups with their residue of the beverage, or storage and transport of the possibly wet and dripping cups until they can be cleaned and dried.

For many of these containers, a threaded cap is provided that can be removed to fill the container or to pour liquids from the container, some having an additional element in the center of the cap having a smaller opening for transferring the liquid directly to the mouth of the user. A push-pull cap is frequently provided for this purpose comprising a sliding dispensing top with a central opening, and a stem configured such that it plugs the opening when the sliding top is depressed and allows liquid to flow through the opening when the sliding top is extended. U.S. Pat. Nos. 5,104,008 and 6,874,664 appear to show such push-pull caps.

Designs of this sort require that the head of the user be tilted back and the container overturned and held nearly vertical over the user's mouth for efficient dispensing of the beverage into the mouth. Such a posture is difficult for small children, may cause spectators to miss portions of the event or action due to averting the eyes to drink, and could be dangerous for bikers, hikers, or boaters by causing changes in posture and field of vision which could cause loss of control or accident. To address this problem, some containers are provided with straws having an internal opening at or near the bottom of the volume of liquid and an external opening above the top of the container through which the user can suck the liquid while the container and the user's head remain upright. U.S. Pat. Nos. 7,516,862 and 4,448,316, and 4,607,755 appear to provide this feature.

A further limitation of these containers is that the empty containers occupy as much volume as the full containers. In many cases it is desirable that the containers be collapsible, so that when beverages are no longer being stored, the volume of the container can be decreased and the empty containers packed into a smaller space, for example, for shipping, disposal, or storage. Several designs of such collapsible containers exist, either having container walls made of flexible material as appears to be provided in U.S. Pat. No. 3,604,491, or incorporating corrugated or "bellows" structures which are designed to collapse along a particular geometry as in U.S. Pat. No. 4,790,361. The addition of a conventional straw to such a container makes collapsing the container more difficult, because the rigid walls of the straw either prevent the bottle from collapsing or kink when folded, making the straw unusable.

In conventional reusable containers, only one opening into the container is provided, and necessarily represents a compromise between ease of filling the container and dispensing from the container, ease of accessing the container for cleaning, and perhaps most importantly, ease of manufacture. The opening is usually sealed with a threaded cap. The threaded openings must typically be manufactured to relatively high tolerances to form a tight seal, and larger openings usually require heavier or more rigid plastics and more expensive manufacturing processes to achieve these tolerances. Consequently, the openings of the containers are usually relatively small, less than an inch across for a normal 8 to 16 ounce container. The small size of the threaded opening typically limits the insertion of cleaning devices such as sponges or brushes required to thoroughly clean such a container, and may leave certain parts of the container such as the inside of the upper shoulder inaccessible for cleaning. Alternative configurations are available in which the opening occupies most of the width of the container which makes them easier to clean, but pouring liquids from a bottle with such a large opening requires more care to avoid spillage, and manufacturing an opening of that size that will reliably seal requires the use of more rigid or thicker materials and tighter tolerances in manufacture.

For collapsible containers, especially those with flexible walls, there is an additional difficulty in unscrewing a cap because the flexible material being held in one hand distorts due to the force applied by the other hand to remove the cap. This difficulty increases dramatically with an increase in the size of the cap, because the twisting force, which can be thought of as opposite forces applied to opposite sides of the cap across the diameter of the cap creating a torque, increases as the diameter of the cap increases.

Accordingly, there is a need for a collapsible container from which a user can drink while the container and the user's head are in a substantially upright position, which can be conveniently filled and from which liquids can conveniently be poured, and which can be fully opened for cleaning. There is a further need for all openings into such a container to be independently and reversibly sealed.

SUMMARY OF THE INVENTION

It is therefore an object of the present invention to provide an improved collapsible drink container.

It is another object of the present invention to provide a collapsible drink container adapted for upright drinking, further adapted for ease of dispensing and filling, and having an interior easily accessible for cleaning.

It is another object of the present invention to provide a container incorporating a straw, a first opening for pouring and filling, and a second opening for accessing the interior of the container.

It is another object of the present invention to provide a reusable, collapsible container incorporating a straw, a first opening for pouring and filling, and a second opening for accessing the interior of the container, wherein the straw, the first opening, and the second opening can each be reversibly sealed.

These and other objects are achieved by providing a drinking container incorporating a straw adapted for drinking, a first opening adapted for pouring and filling, and a second opening adapted for fully accessing the interior of the container. In some embodiments, the opening for pouring and filling is reversibly sealed with a threaded cap. In some embodiments, the opening for accessing the interior of the container is sealed with an interlocking ridge and groove fastener.

In some embodiments the container is collapsible. In these embodiments, the container reversibly occupies at least a collapsed configuration and an expanded configuration, wherein the volume occupied and defined by the collapsed configuration is less than the volume occupied and defined by the expanded configuration. In some embodiments, collapsing the container reduces the volume by bringing remote sections of the container wall into contact with each other. In other embodiments, the orientation of related portions of the container wall to each other is reversibly altered. In some embodiments, one or more fold lines are scored or molded into the container wall, and the angle between sections on opposite sides of a fold line increases to form the expanded configuration of the container and decreases to form the collapsed configuration. In some embodiments, one or more fold lines extend around at least a part of the perimeter of the container wall, and allow the container to collapse in a generally axial direction. In at least one embodiment, a fold line forms a spiral around the container wall.

In some embodiments, the straw is reversibly sealed with a removable cap. In other embodiments, the straw is reversibly sealed using an element that reversibly kinks the straw. In other embodiments, the straw is reversibly sealed using an element that moves the passageway through one portion of the straw with respect to the passageway through another portion of the straw, such that the passageway through the straw is reversibly discontinuous. In other embodiments, a push-pull cap is provided in a portion of the passageway through the straw, sealing the passageway in its depressed configuration and allowing liquid to flow in its extended configuration. In other embodiments, the passageway through the straw incorporates a valve configured to allow fluid passage in only one direction through the straw.

In many embodiments, the straw-sealing element and the attachment of the straw to the container are integral portions of the cap sealing the opening provided in the container for pouring and filling. In other embodiments, the attachment of the straw to the container is a grommet in the container wall. A grommet is a ring or eyelet in the container wall, in some embodiments made of an elastomeric material, through which the straw can be inserted, and which forms a seal between the straw and the container wall. In still other embodiments, the straw is provided with an element having a ridge and groove feature configured to mate with the interlocking ridge and groove fastener sealing the second opening. In this embodiment, the straw is inserted into the second opening and sealed in place with the interlocking ridge and groove fastener.

In some embodiments, at least a portion of the container wall is flexible. In some embodiments, at least a portion of the straw is flexible. In some embodiments, at least a portion of the straw is an integral part of the container wall. In some embodiments, at least a portion of the straw is an integral part of the cap sealing the opening provided in the container for pouring and filling.

In some embodiments, the container further comprises a one-way valve configured to allow air into the container as the contents are removed. In one embodiment having a grommet for attaching the straw to the container, the grommet is further configured to act as a one-way valve, allowing air to enter between the grommet and the straw sidewalls as pressure is reduced inside the container, but sealing to prevent air or liquid from escaping the container as pressure is increased inside the container.

In some embodiments, the container wall further comprises at least one fold line. In some embodiments, the fold line extends around at least a part of a perimeter of the container wall for permitting the container to collapse in a generally axial direction.

In some embodiments having a collapsible container, when the container is upright and in the expanded configuration, the interior opening of the straw is located at or near the bottom of the container, and the first and second openings are located at or near the top of the container. In some embodiments, the container further comprises a top surface and a bottom surface opposite to the top surface, with the first and second openings located in the top surface and the internal opening of the straw located near the bottom surface. In some embodiments, when the container is upright and in its expanded configuration, most of the volume of the container is between the interior opening of the straw and the lowest of either the first or second opening.

In some embodiments, the invention comprises a container which reversibly occupies at least a collapsed configuration and an expanded configuration, the expanded configuration having a larger volume than the collapsed configuration; a first opening located at or near the top of the container when the container is upright and in its expanded configuration, the first opening reversibly sealed with a cap; a second opening located at or near the top of the container when the container is upright and in its expanded configuration, the second opening reversibly sealed with an interlocking ridge and groove fastener; and a straw having an interior opening at or near the bottom of the container when the container is upright and in its expanded configuration, the straw reversibly sealed with a straw sealing element. In some embodiments the straw is attached to the container wall either directly or by means of one of the following: a grommet in the container wall, a portion of the straw formed as an integral part of the cap, or a ridge and groove element attached to the straw configured to mate with the interlocking ridge and groove fastener.

BRIEF DESCRIPTION OF DRAWINGS

FIGS. 16A-6H depict alternative straw sealing elements for use with the embodiment shown in FIG. 1.

DETAILED DESCRIPTION

Figure 2A:
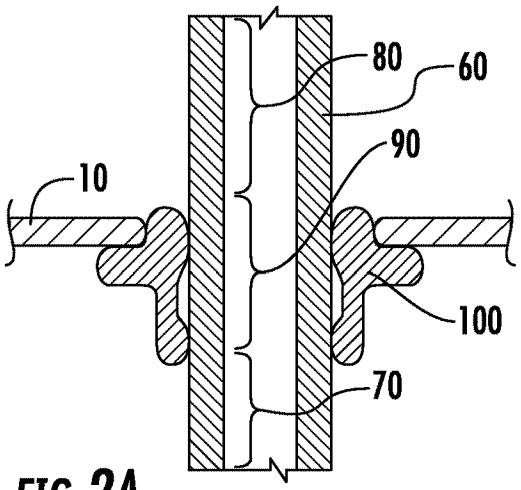
FIGS. 2A and 2B are detail views of FIG. 2 showing alternative attachments of the straw to the container wall having the second opening unsealed.
Figure 2B:
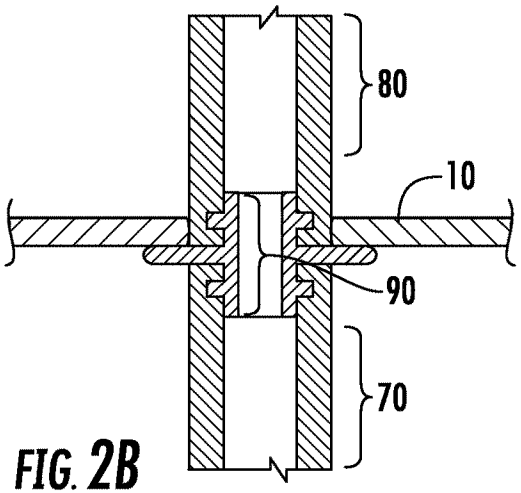
Figure 2:
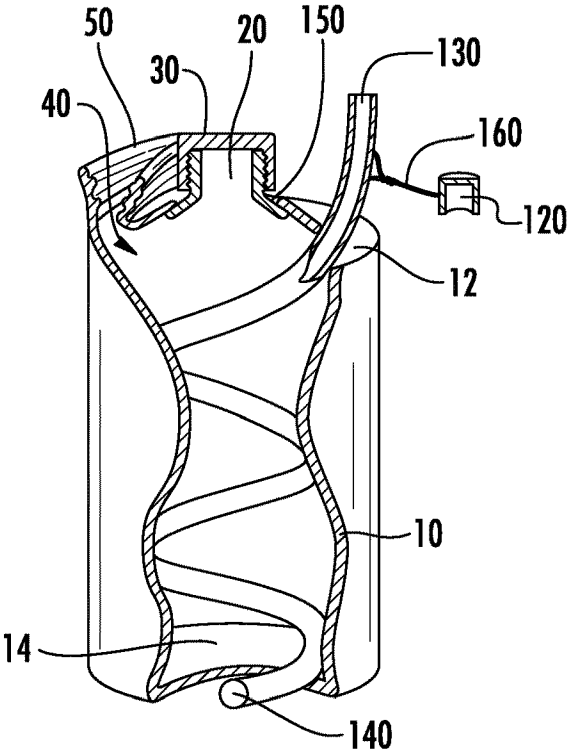
FIG. 2 depicts a cutaway view of the embodiment shown in FIG. 1.
Figure 1:
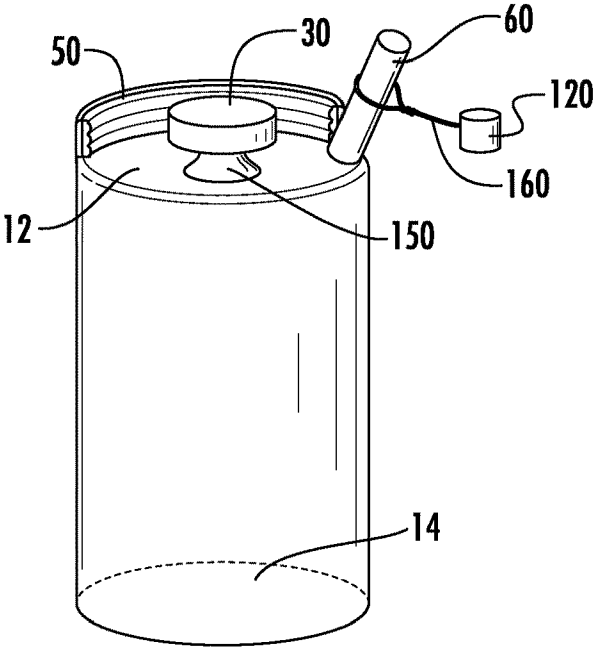
FIG. 1 depicts an embodiment of the current invention.
Figure 4:
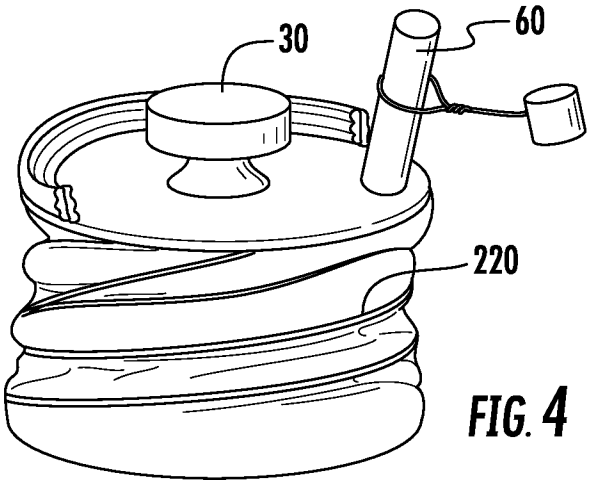
FIG. 4 depicts the embodiment shown in FIG. 1 in an alternate position.

Referring now to the drawings, in which like numerals indicate like elements throughout the several views, FIG. 1 depicts an embodiment of a collapsible container constructed in accordance with the present invention, while FIG. 2 depicts a cutaway view showing the interior elements of the same embodiment. The container is formed from a container wall (10) which surrounds and defines the volume contained. In this embodiment, the container wall is flexible, and the volume of the container can be reversibly reduced by collapsing the container, as shown in FIG. 4. Although many containers are frequently collapsed for disposal, including tin cans and glass bottles, for the purposes of this application, a "collapsible container" is one having a volume that is intended to be reversibly reduced during normal use by alternately collapsing and expanding the container. Therefore, a collapsible container reversibly occupies at least a collapsed configuration and an expanded configuration. This is distinguished further in the current invention from containers that are intended to be irreversibly collapsed once either as the contents are dispensed or after the container is emptied, and then discarded.

In its collapsed configuration, both the volume occupied by the collapsible container and the interior volume defined by the container are reduced compared to the volume occupied and defined by the container in its expanded configuration. Collapsible containers are useful in that they can be reduced to smaller volumes for transport or storage of the container when their maximum volume is not required for transport or storage of the contents of the container, then expanded to store or transport a maximum volume of liquid. Collapsible containers are also useful in that they can be partially collapsed as needed to reduce the amount of headspace over a sub-maximal volume of liquid. This is useful especially for storage of carbonated beverages, in which the amount of carbonation at equilibrium in a sealed container is in part related to the volume of air, known as headspace, over the liquid. Reducing the volume of the container reduces the headspace, resulting in desirably higher levels of carbonation in the beverage. Other liquids such as wines, which may be sensitive to the total amount of oxygen in the headspace of the container, or liquids which have a volatile flavor or odor component that might be lost or diluted in larger volumes of air, can also benefit from a container that can be reduced in total volume as the volume of liquid content is decreased.

Figure 4C:
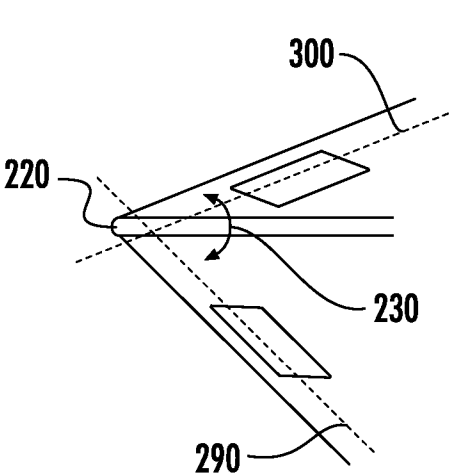
FIGS. 4A-4E show changes in geometry of sections of the container wall and straw as the embodiment shown in FIG. 1 adopts the position shown in FIG. 4.
Figure 4B:
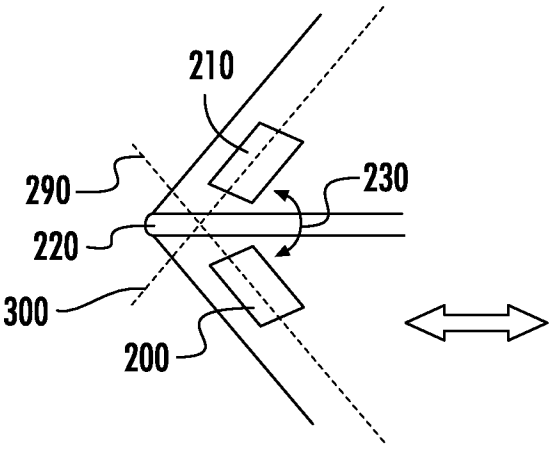
Figure 4A:
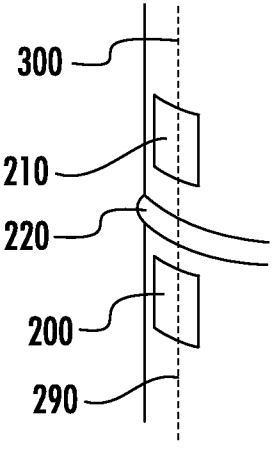
Figure 7:
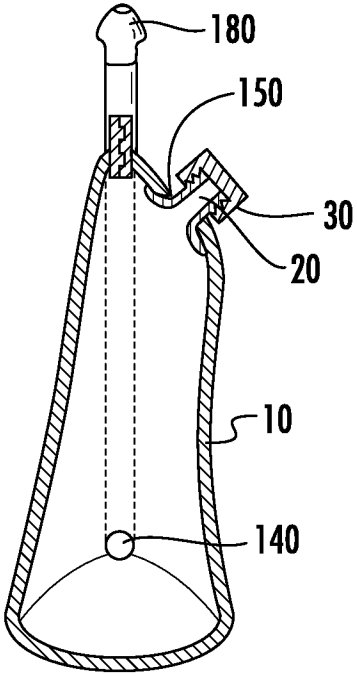
FIG. 7 depicts a section view of the configuration shown in FIG. 7.
Figure 9:
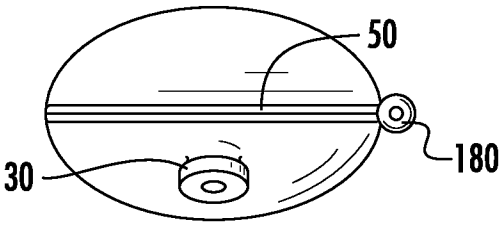
FIG. 9 depicts a top view of the configuration of FIG. 7.

Collapsing the container alters the orientation and position of some sections of the container wall with respect to other sections of the container wall. As can be seen in FIGS. 4A, 4B, and 4C, in this exemplary embodiment, a first section (200) of container wall lying substantially along a first axis (290) and a second section (210) of the container wall lying substantially along a second axis (300) can be considered. When the container is in its expanded configuration shown in FIGS. 1 and 4A, the first and second axes are oriented to be substantially co-linear, having an angle of intersection (230) at or near 180°. When the container is in the collapsed configuration shown in FIG. 4 and FIG. 4C, the orientation has changed such that the angle of intersection (230) between the first and second axes is acute, and approaches zero as the container is completely collapsed and the first and second sections make contact. Both reversible changes in orientation and reversible changes in distance between two sections of container wall can be characteristic of a collapsible container. For example, in the embodiment shown in FIGS. 7 and 8, remote sections of container wall on opposite sides of the container in the expanded configuration shown in FIG. 7 are brought into contact with each other in the collapsed configuration shown in FIG. 8 without substantial alteration in the angle between their axes.

In some embodiments, a fold line (220) is provided in the container wall to guide the geometry of collapse of the container. In some embodiments, the fold line is a weak point scored into the wall to add flexibility specifically to that portion of the wall and allow the wall sections adjacent to the fold line to change orientation along the fold. In some embodiments, the fold line is a thicker section or bead added to the wall to stiffen and maintain a specific geometry of the wall, and the thinner, more flexible sections of wall between the fold lines collapse. The geometry and orientation of the fold line can advantageously direct the orientation of the collapse of the container. In the embodiment shown in FIG. 1, the fold line (220) is in the form of a spiral about the perimeter of the container, which allows the container to collapse in a generally axial direction. This advantageously maintains the location of the openings at the top of the volume defined by the container and the internal opening of the straw at the bottom of the volume defined by the container as the container is partially or fully collapsed during use.

Figure 8A:
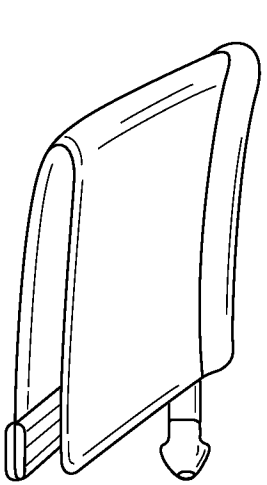
FIGS. 8A and 8B depict the configuration of FIG. 7 in additional alternate positions.
Figure 8B:
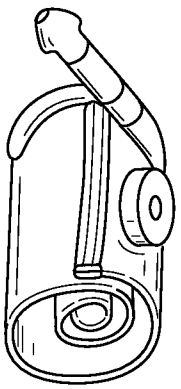
Figure 8:
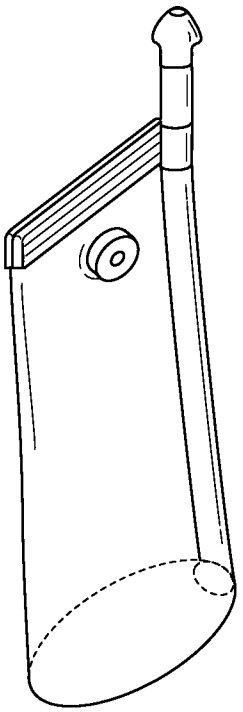
FIG. 8 depicts the configuration of FIG. 7 in an alternate position, namely its collapsed form.
Figure 10:
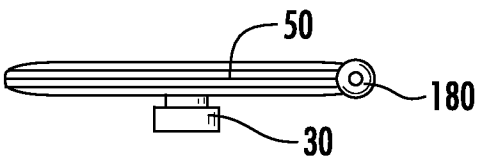
FIG. 10 depicts a top view of the configuration of FIG. 7 in an alternate position, namely its collapsed form.

In some embodiments, fold lines are formed during the manufacturing process as a natural result of joining two pieces of material. In the embodiment shown in FIGS. 6, 7, and 8, fold lines (220) are located at the sides and around the perimeter of the bottom of the volume, allowing the opposing sides to collapse inwards and the bottom surface to collapse upwards, advantageously maintaining the position of the first and second openings at the top of the container and the internal opening of the straw at the bottom of the container as the volume of the container is reduced. As can be seen in FIGS. 8A and 8B, additional collapse of the container in directions other than those determined by the fold lines are still possible, including folding or rolling the collapsed or at least partially collapsed container.

The embodiment shown in FIG. 1 further comprises a straw (60). For the purposes of this application, a straw during normal use has sidewalls (190) that define a fluid passageway extending from an internal opening (140) located within the container and below the surface of a liquid to an external opening (130) located outside the container and above the surface of the liquid, through which the liquid can be transported by reducing the pressure at the external opening relative to the internal opening, for example, by sucking on the external end of the straw or by squeezing the container. A straw so defined can be seen as having an interior (with respect to the container) section (70) comprising the internal opening (140) and any portion of the passageway extended from the container wall into the interior volume of the container; an exterior (with respect to the container) section (80) comprising the external opening (130) and any portion of the passageway extended externally from the container wall; and a central section (90) comprising the portion of the passageway connecting the interior and exterior section of the passageway and forming an attachment to the container wall.

Figure 6:
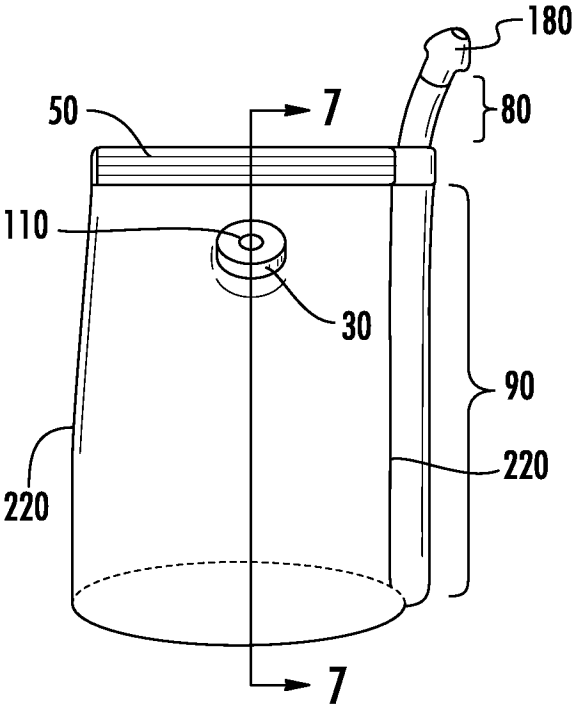
FIG. 6 depicts an alternate configuration of the embodiment shown in FIG. 1.
Figure 12:
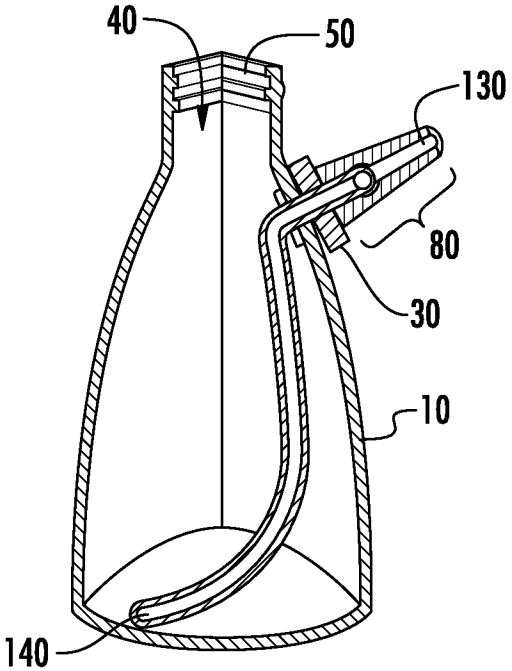
FIG. 12 depicts a section view of the configuration shown in FIG. 12.

In some embodiments of this invention, the sidewall defining the central section of the straw is attached directly to the walls of the container. Such an attachment seals the straw to the container and prevents the escape of liquid between the sidewalls of the straw and the container wall, as is possible when a conventional straw is placed into a conventional container opening. The attachment between the sidewall of the straw and the container wall can be formed by any method known to the art, including by molding or forming at least the central section of the straw as an integral part of the container wall, by gluing at least the central section of the straw into an opening in the container wall, or by partially melting either the container wall or the sidewall of the central section, or both, to form an attachment in a heat-welding process. In some embodiments, as shown in FIG. 2A, a grommet (100) is provided on the container wall through which the straw can be inserted, the sidewalls of the central section of the straw forming a seal with the walls defining the opening in the grommet. In some embodiments, as exemplified in FIG. 2A, the grommet (100) is configured to act as a one-way valve, allowing air to enter the container around the sidewalls of the straw but preventing the air from escaping. Such a configuration is shown, for example in U.S. Pat. No. 3,291,331. In other embodiments, a one-way valve (110) is attached to the cap (30) as shown in FIG. 6, or is separately attached to the container wall as shown in FIG. 12. The provision of a one-way valve allows air to enter the container as the liquid contents are removed through the straw, preventing the buildup of a partial vacuum which would reduce the efficiency of the straw. As pressure is reduced inside the container, for example by sucking some of the liquid contents out through the straw, the one-way valve allows air to enter the container and equalize the pressure. If pressure is increased inside the container, however, for example by storage of carbonated beverages, or by squeezing or jarring the container, the one-way valve prevents the expulsion of air or liquid contents through the valve opening in response to the increased pressure. In many embodiments, no one-way valve is provided, and the collapsing of the container walls and subsequent reduction in container volume suffices to relieve the partial vacuum formed by removing the liquid contents.

Figure 4E:
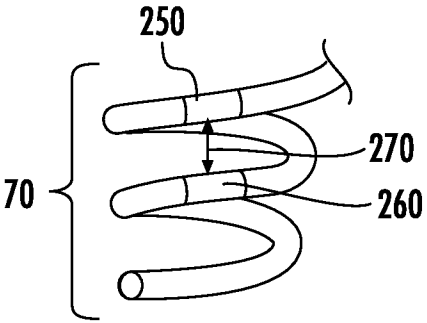
Figure 4D:
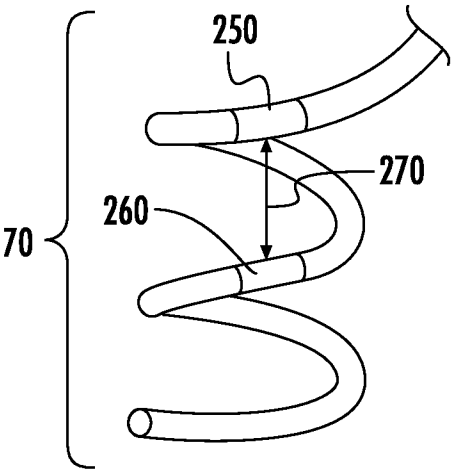

In some embodiments, at least a portion of the interior section (70) of the straw is flexible. This flexibility allows the interior section (70) of the straw to conform to the shape of the container as the container is collapsed without reducing the efficiency of the straw. Conventional straight straws, typically made of paper, cardboard, or relatively thin plastic, kink when they are substantially flexed, severely reducing the cross-sectional area of the fluid passageway and restricting the flow of liquid through the straw. In a flexible straw, the distance between two remote sections of the straw can be increased or decreased without substantially altering the cross-sectional area of any part of the passageway between the two sections. In some embodiments, a flexible sidewall is incorporated into the straw by forming corrugations in the sidewall of the straw, creating a bellows section which allows the straw to bend substantially without kinking or significantly reducing the cross sectional area or resistance to flow of the fluid passageway. In other embodiments, the geometry of the straw introduces the necessary flexibility. In the exemplary embodiment shown in FIG. 2, a portion of the straw is formed in the shape of a spiral, which can be compressed along the axial length of the spiral. Characteristic of a flexible straw, it can be seen from FIGS. 4D and 4E that a first portion of the straw (250) and a second portion of the straw (260) are at a larger distance (270) when the container is in its expanded position as shown in FIGS. 2 and 4D, and at a smaller distance (270) when the container is in its collapsed position as shown in FIG. 4E. The spiral geometry of the straw in this embodiment allows the distance between portions of the straw to decrease without kinking or substantially reducing the cross-sectional area of the straw.

Figure 15:
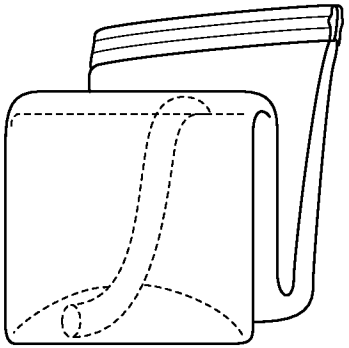
FIG. 15 depicts a back view of the configuration and position shown in FIG. 14.
Figure 14:
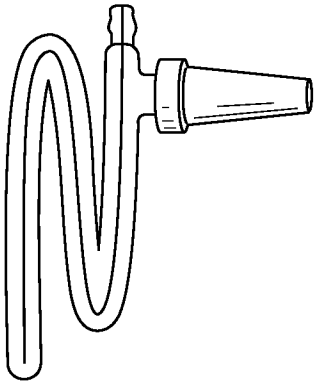
FIG. 14 depicts a side view of the configuration shown in FIG. 12 in an alternate position, namely its collapsed form.

In still other embodiments, as shown in FIGS. 14-15, a portion of the straw is formed from flexible elastomeric tubing having a wall thickness and stiffness sufficient to maintain a fluid passageway as the container is collapsed and the tubing flexed. Food grade tubing is widely available in a variety of sizes and materials, and a skilled craftsman is able to select the appropriate material based on the configuration of the container and the flex required of the straw to conform to the shape of the collapsed form of the container without kinking.

In some embodiments, as shown in FIG. 2A, the straw is a single piece of tubing which extends from the internal opening (140) of the fluid passageway, through the container wall (10), to the external opening of the fluid passageway (130). In other embodiments, the interior section (70) of the straw is formed separately and is attached to the central section (90) of the straw in differing embodiments by threaded connections, hose barbs, tubular projections providing a friction fit for the tubing, adhesives, or heat-welding. In other embodiments, the exterior section (80) of the straw is formed separately and attached to the central section (90) of the straw in differing embodiments by threaded connections, hose barbs, tubular projections providing a friction fit for the tubing, adhesives, and heat-welding. In further embodiments, such as that shown in FIG. 2B, both the interior section (70) and the exterior section (80) of the straw are formed separately from the central section (90), and are each attached to the central section of the straw. In the configuration shown in FIGS. 6-10, the central section (90) of the straw is formed as an integral part of the container wall from near the top of the container to near the bottom of the container, leaving only the internal opening (140) as the interior section of the straw.

It has been found that, for drinking from a container held in an upright position, it is most advantageous that the internal opening of the straw be at or near the bottom of the volume defined by the container, at least in its expanded configuration. This allows retrieval of the maximal amount of volume without resorting to tilting or overturning the container. Contrariwise, it is advantageous that the external opening of the straw be above the volume defined by the container, to avoid the siphoning or splashing out of the contents which could occur if the liquid inside the container rose to a level higher than the external opening of the straw.

The invention further comprises a first opening (20) configured for filling or dispensing liquids from the container, and a second opening (40) configured for fully accessing the interior of the container, each opening being provided with an element for reversibly sealing the opening. In the embodiment shown in FIG. 1, the first opening is reversibly sealed with a removable cap (30). In other embodiments, the first opening is reversibly sealed with a flip-top cap. In some embodiments, the first opening is provided as a separately manufactured spout (150) having preformed external threads, the spout being attached to the container wall using, for example, adhesives or heat welding. The first opening is sealed with a removable cap (30) having internal threads mating with the external threads on the spout. In other embodiments, a spout defining the first opening is formed as an integral part of the container wall.

An interlocking ridge and groove fastener (50) is surprisingly effective for providing a reversible seal for the second opening (40). These fasteners are commonly known as "ziplock" fasteners, a word that has now entered at least the Merriam-Webster online dictionary as meaning "having an interlocking groove and ridge that form a tight seal when pressed together". Such seals are commonly featured in the bags sold under the ZIPLOC® brand family by S. C. Johnson & Son, Inc., and the manufacture of such seals and of flexible containers provided with such seals are well within the competence of a skilled practitioner of the art. A variety of ridge and groove designs are commercially available, and designs can be selected to provide a reliable air-tight and water-tight seal that can be easily unsealed for cleaning and resealed for transport and storage. The use of an interlocking ridge and groove fastener permits the manufacture of larger sealable openings without the manufacturing difficulties, materials constraints, tight tolerances, and rigidity associated with traditional large bottle openings.

Although the first and second openings are reversibly sealed, to prevent accidental release of the contents due to seal failure or misuse, it is advantageous in many embodiments to locate both the first and second openings at or near the top of the container when the container is upright and in the expanded configuration. It is advantageous to have a maximal amount of the volume defined by the container in the expanded configuration located between the internal opening of the straw, located at or near the bottom of the container, and the lowest of the first or second openings located at or near the top of the container. This permits convenient ingestion by a user of substantially all of the contents of the container with little risk that any inadequate or improperly applied seal of either the first or second opening will result in significant spillage. In some embodiments, for example the embodiment depicted in FIG. 1, the container wall has a top surface (12), the interior portion of which defines the top of the volume, and sopposite to the top surface, a bottom surface (14), the interior portion of which define the bottom of the volume. In some embodiments the first and second opening are located in the top surface, such that the openings pass through the top surface to enter the volume. This advantageously permits maximal filling of the container while it is in its upright position, without the necessity of tilting the container to increase the fill volume. In some embodiments, the internal opening of the straw is located proximate to the interior portion of the bottom surface. In some embodiments, the straw also passes through the top surface, independent of the first and second openings.

Figure 11:
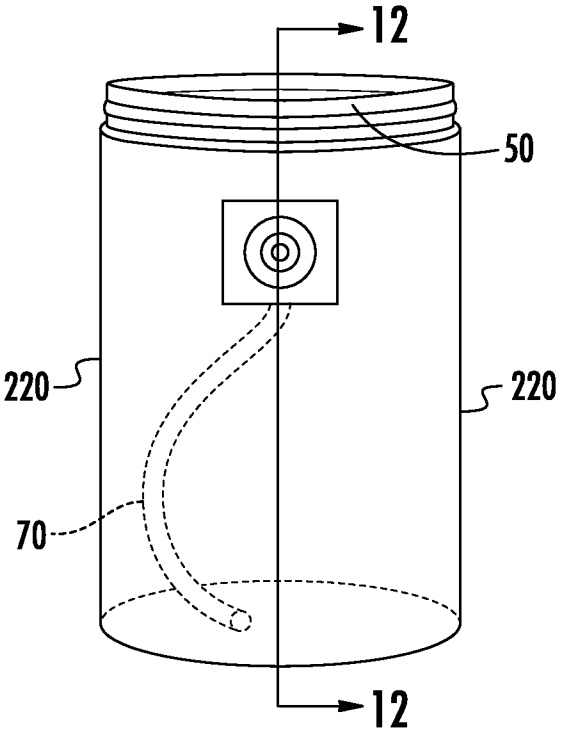
FIG. 11 depicts an alternate configuration of the embodiment shown in FIG. 1.

In some embodiments, as shown in FIGS. 6 and 11, the container wall slopes up to the second opening in a top edge of a container without a well-defined top surface, and the first opening is located near the top of the volume. Although these configurations decrease the total fill volume that can be obtained through the first opening in the upright position, they also advantageously reduce manufacturing complexity and cost. In some embodiments, both the first and second openings are located in a top edge of a container.

Figure 5:
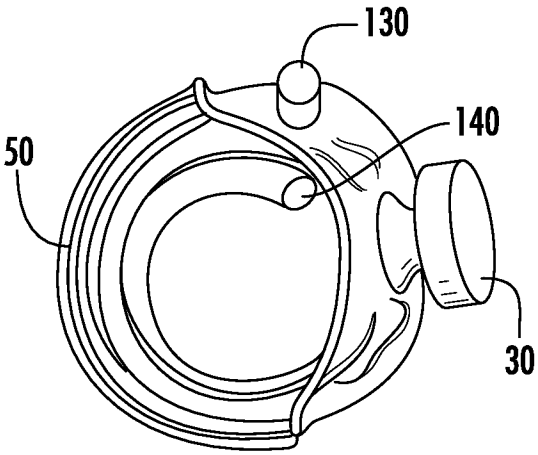
FIG. 5 depicts a top view of embodiment shown in FIG. 1 in the alternative position shown in FIG. 3.
Figure 3:
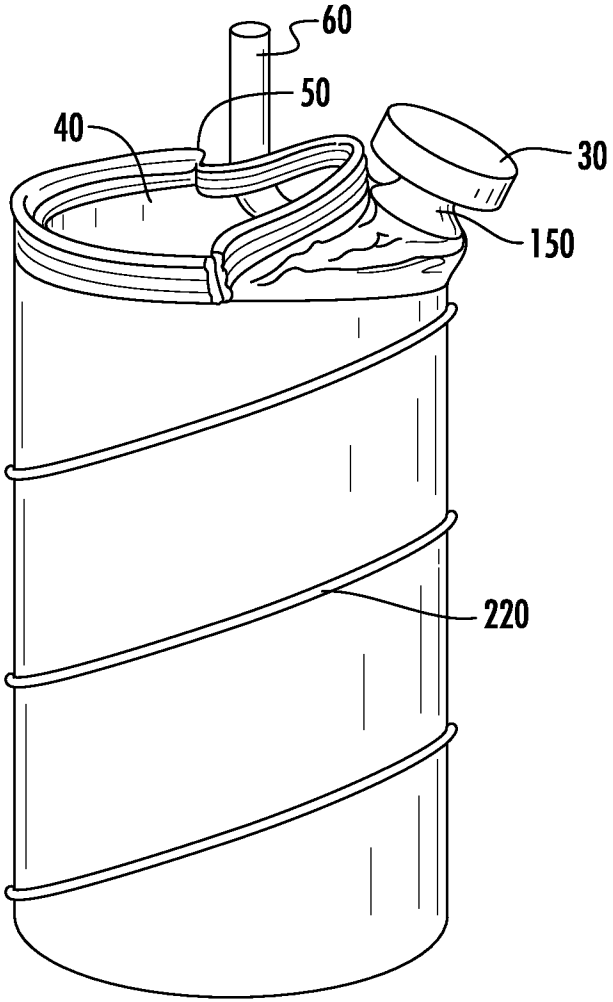
FIG. 3 depicts a side view of the embodiment shown in FIG. 1 in an alternate position.
Figure 13:
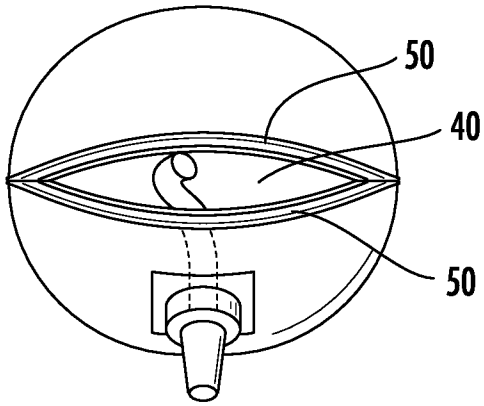
FIG. 13 depicts a top view of the configuration shown in FIG. 12.

The flexibility of the interlocking ridge and groove fastener advantageously allows for a flexible opening provided in a container wall, at least a portion of which is flexible. As shown best in FIGS. 5 and 13, the combination of an interlocking ridge and groove fastener (50) and flexible container walls allows the container to be opened sufficiently to allow access through the second opening (40) to all of the interior surfaces of the container for cleaning, while still providing an easy-to-use and easy-to-manufacture seal to prevent leakage of the container or contamination of the contents. The larger and more flexible nature of such an opening compared to the conventional container opening also permits greater access to the interior of the container for manufacturing purposes, such as attaching the central section of the straw to the container wall, attaching a threaded spout for a first opening or a grommet for a straw seal, or attaching the interior section of the straw to the central section of the straw. The second opening (40) also permits the addition of larger solids such as ice, spoonfuls of sugar, or powdered drink mixtures into the container, very difficult processes for most conventional resealable drinking containers.

In some embodiments, the straw is provided with an element for reversibly sealing the fluid passageway to prevent the contents of the container from being spilled or contaminated during transport or storage, as shown in FIGS. 16A-G. In some embodiments, the straw sealing element is a removable cap (120). In the embodiment depicted in FIG. 16A, the cap (120) is pressed over the external opening (130) of the straw and pulled to remove, leading to ease of manufacture and use. In the embodiment depicted in FIG. 16B, the cap (120) is threaded to fit matching threads on the straw, which produces a more reliable seal. In the embodiment depicted in FIG. 16C, the straw sealing element is a removable plug (170) which fits tightly into the external opening. In some embodiments, a cap or plug straw sealing element includes a tether (160) attached to either the straw or the container to prevent loss of the sealing element when the straw is in use.

In the embodiment depicted in FIGS. 6-10 and FIG. 16D, the straw sealing element is a push-pull cap (180) located at the external opening of the straw, advantageously reducing the chance that the sealing element will be lost or will wear to the extent that it will no longer form a reliable seal. In the embodiment depicted in FIG. 16E, the straw sealing element is a push-pull cap integrated with the central section of the straw, advantageously allowing the exterior section of the straw to be formed to a more comfortable configuration for mouth contact and reducing the labor involved in adding an additional element to the end of the straw during assembly.

Figure 16A:
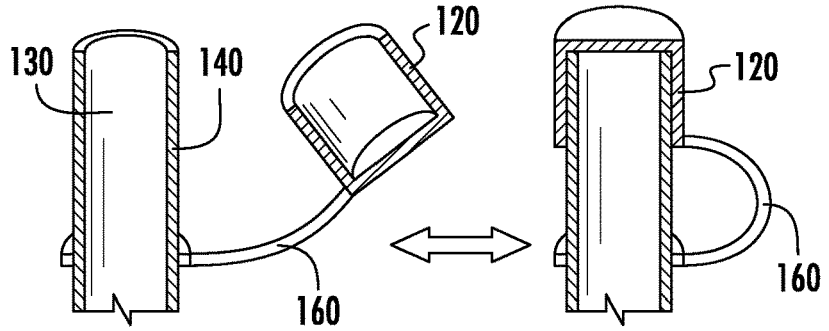
Figure 16B:
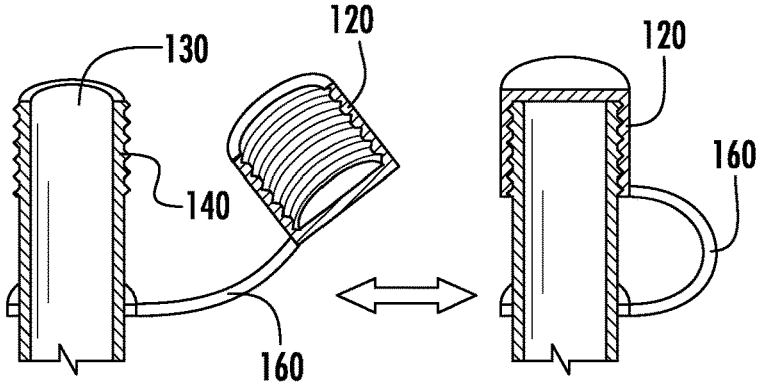
Figure 16C:
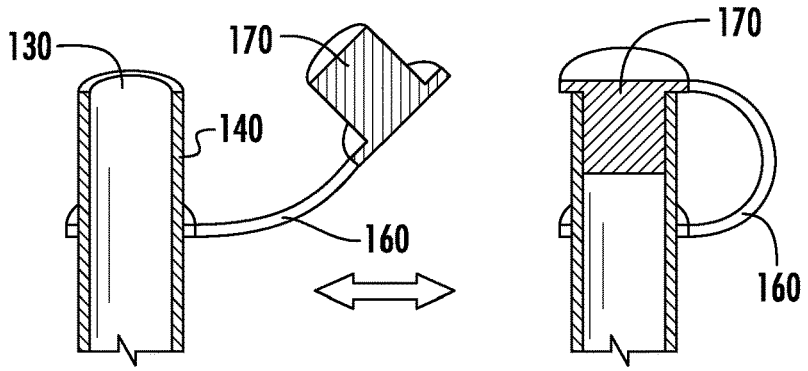
Figure 16D:
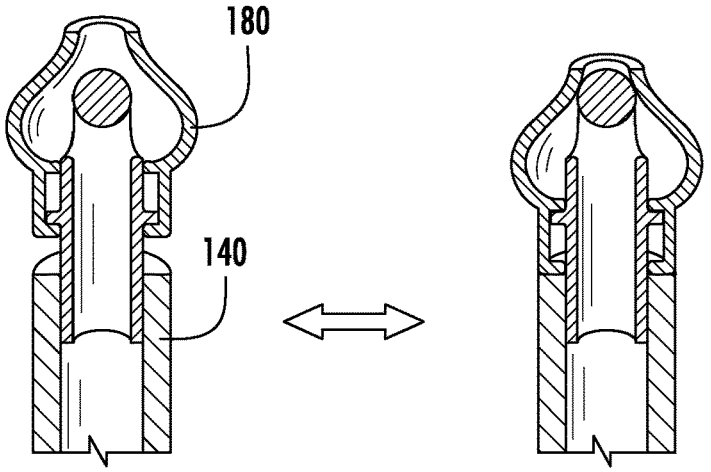
Figure 16E:
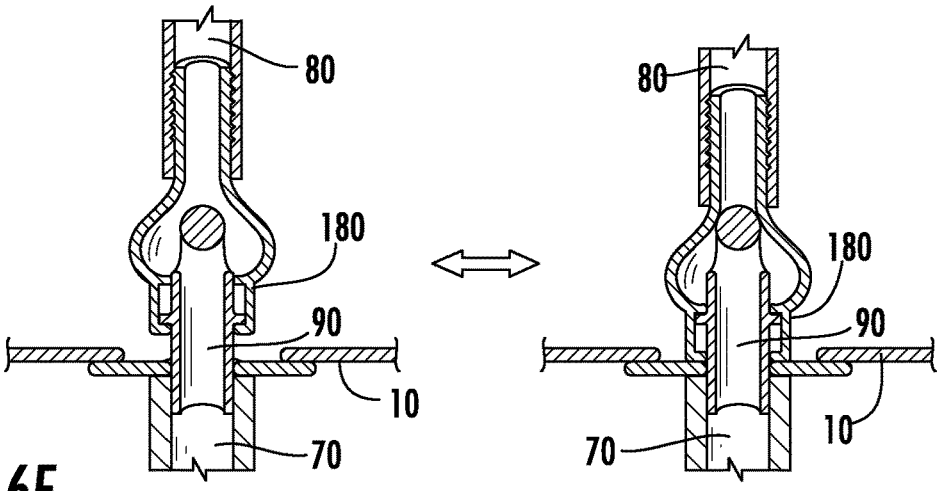
Figure 16F:
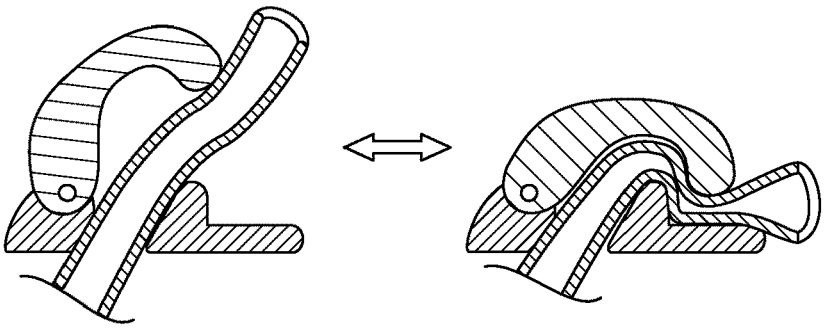

In other embodiments, the straw sealing element is an element configured to reversibly kink a flexible section of the straw, as exemplified in FIG. 16F. These elements are designed to apply pressure to collapse the fluid passageway when the straw is to be sealed; when the pressure is released, the flexible tubing reverts to its previous form and reopens the fluid passageway.

Figure 16G:
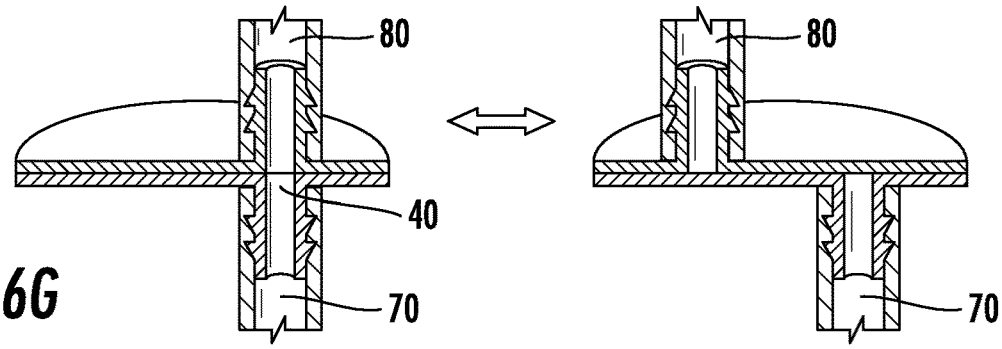
Figure 16H:
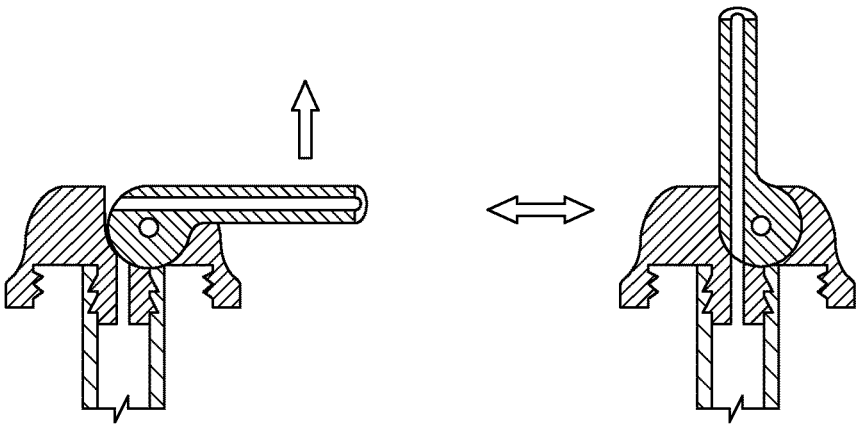
Figure 17:
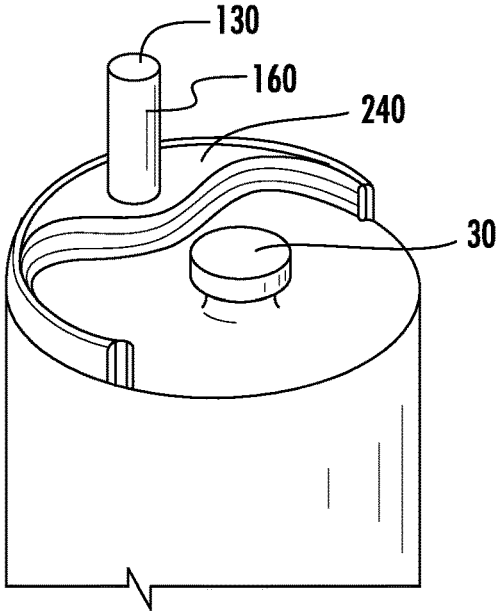
FIG. 17 depicts the upper portion of an alternate configuration of the embodiment shown in FIG. 1.
Figure 18:
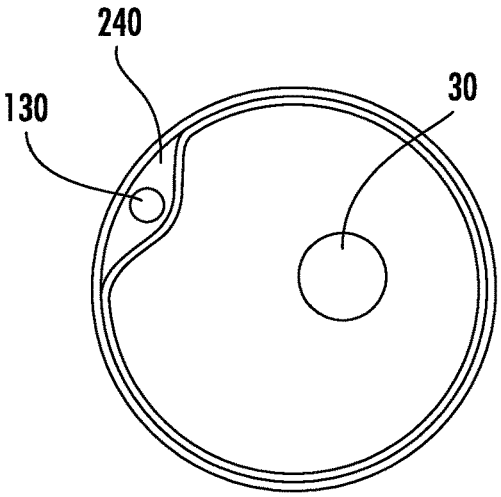
FIG. 18 is a top view of the configuration shown in FIG. 17.
Figure 19:
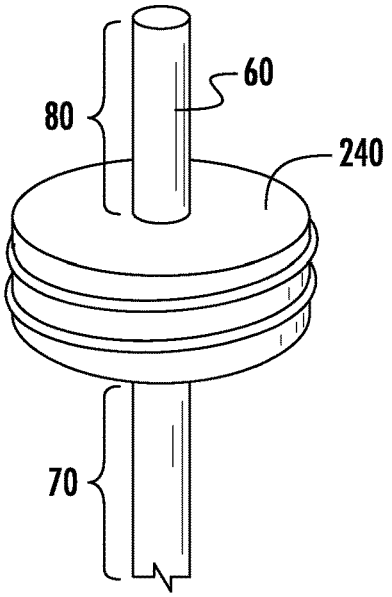
FIG. 19 is a view of the straw depicted in FIG. 17.
Figure 20:
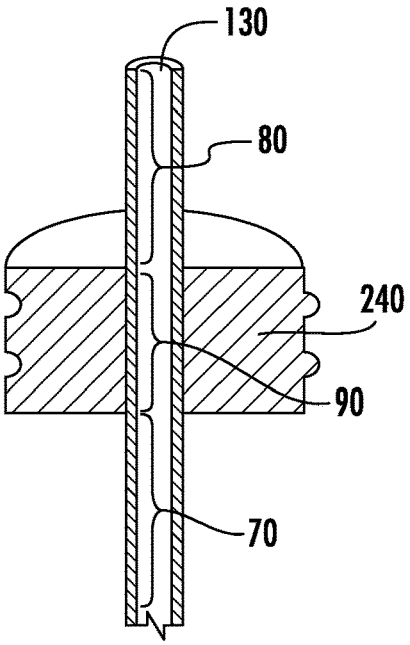
FIG. 20 is a section view of the straw depicted in FIG. 19.

In other embodiments, the straw is reversibly sealed by providing a reversibly discontinuous element in the fluid passageway, as exemplified in FIGS. 16G and 16H. These elements are designed to separate and seal the ends of two sections of a fluid passageway when the passageway is not in use, and line up the sections to complete the passageway when it is in use.

In the configuration shown in FIGS. 11-15, the central section of the straw is formed as an integral part of the cap (30) provided for reversibly sealing the first opening. This configuration advantageously permits the straw to be easily removed for cleaning or replacement and reduces the manufacturing complexity of providing an additional element to be sealed to the container wall. In other, separate embodiments, other forms of straw sealing elements such as an element designed to reversibly kink a section of the straw or a reversibly discontinuous element are incorporated into the cap (30) provided for reversibly sealing the first opening to reduce manufacturing cost and complexity.

In the configuration shown in FIGS. 17-20, the central section (90) of the straw includes a ridge and groove element (240) configured to mate to the interlocking ridge and groove fastener (50) that seals the second opening. This advantageously allows the straw to be sealed within the second opening, reducing manufacturing costs by eliminating the step of directly attaching the straw to the container wall, and permitting easy removal of the straw for cleaning or replacement.

While the present invention has been particularly described, it is evident that many alternatives, modifications, and variations will be apparent to those skilled in the art in light of the foregoing description. It is therefore contemplated that the appended claims will embrace any such alternatives, modifications, and variations as falling within the true scope and spirit of the present invention.

What is claimed is:

1. A container comprising:

a container wall defining a volume;

said volume having a top and a base;

a first opening into said volume defining a first passageway;

a cap configured to seal said first opening;

a second opening into said volume defining a second passageway;

wherein said first and second openings are vertically adjacent to each other;

wherein said first and second passageways are separate from each other;

an interlocking ridge and groove fastener configured to seal said second opening;

a straw defining a passageway into said volume, said straw further comprising an attachment to said container wall.

2. Said container of claim 1 wherein said container reversibly occupies a collapsed configuration defining a first volume and an expanded configuration defining a second volume, wherein said second volume is greater than said first volume.

3. Said container of claim 2 wherein said container wall further comprises at least a first section and a second section, and wherein said first section is in contact with said second section when said container is in said collapsed configuration and said first section is not in contact with said second section when said container is in said expanded configuration.

4. Said container of claim 2 wherein said container wall further comprises at least a first section lying along a first axis and a second section lying along a second axis, said second axis intersecting said first axis to form a first angle of intersection when said container is in said collapsed configuration and a second angle of intersection when said container is in said expanded configuration, and wherein said first angle of intersection is different from said second angle of intersection.

5. Said container of claim 2 wherein said straw further comprises an interior section surrounded by said volume:

said interior section comprising a sidewall between said passageway and said volume;

said passageway having a first cross-sectional shape and dimension at each point along its length when said container occupies said collapsed configuration and a second cross-sectional shape and dimension at each point along its length when said container occupies said expanded configuration;

said sidewall having at least a first portion and a second portion located at a first distance from each other when said container occupies said collapsed configuration and located at a second distance from each other when said container occupies said expanded configuration.

6. Said container of claim 4 further comprising at least one fold line in said container wall between said first section and said second section.

7. Said container of claim 6 wherein said fold line extends in an axial direction on at least a part of said container wall for permitting said container to collapse in a generally radial direction.

8. Said container of claim 6 wherein said fold line extends around the perimeter of said case proximate to the base of said volume.

9. Said container of claim 1 further comprising a grommet in said container wall, said grommet sealing said straw to said container.

10. Said container of claim 9 wherein said grommet further comprises a one-way valve configured to allow air into said container.

11. Said container of claim 1 further comprising a straw sealing element for reversibly sealing said passageway defined by said straw.

12. Said container of claim 11 wherein said straw sealing element is selected from said group consisting of a removable cap for said straw, an element for reversibly kinking said straw, a reversibly discontinuous portion of said straw, a valve configured to allow fluid passage in only one direction through said straw, and a push-pull cap for said straw.

13. Said container of claim 1 wherein said straw further comprises an interior opening from said passageway into said volume at a location proximal to said base of said volume, and wherein said first and second openings are located proximal to said top of said volume when said container is oriented in an upright position.

14. Said container of claim 1, wherein said straw comprises a ridge and groove element configured to mate with said interlocking ridge and groove fastener.

15. A container comprising:

a container wall defining a sole compartment, wherein said container wall reversibly occupies at least a collapsed configuration defining a first volume and an expanded configuration defining a second volume, and wherein said second volume is greater than said first volume;

wherein said first and second volumes have a top and a bottom;

a first opening into said sole compartment, located substantially at said top of said second volume when said container is in an upright position;

a cap for reversibly sealing said first opening;

a second opening into said sole compartment, located substantially at said top of said second volume when said container is in an upright position;

a third opening into said sole compartment, located substantially at said top of said second volume when said container is in an upright position;

an interlocking ridge and groove fastener for reversibly sealing said second opening;

a straw defining a passageway into said sole compartment, said straw having an interior opening from said passageway into said sole compartment, said opening located substantially at said bottom of said second volume when said container is in an upright position, wherein at least a portion of said straw is attached to said container wall;

wherein said passageway is separate from said first and second and third openings;

a straw sealing element for reversibly sealing said passageway.

16. Said container of claim 15, wherein said straw is attached to said container wall using an element selected from said group consisting of: a direct attachment to said container wall, a grommet in said container wall, a portion of said straw formed as an integral part of said cap, and a ridge and groove element attached to said straw configured to mate with said fastener.

17. Said container of claim 15, wherein said straw comprises a ridge and groove element configured to mate with said interlocking ridge and groove fastener.

18. Said container of claim 15, wherein actuation of said container between said collapsed and expanded configurations is by a fold line that forms an axial line on said container wall.

19. A container comprising:

a container wall defining a volume;

a first opening into said volume defining a first passageway;

a cap configured to seal said first opening;

a second opening into said volume defining a second passageway;

wherein said first and second openings are vertically adjacent to each other;

wherein said first and second passageways are separate from each other;

an interlocking ridge and groove fastener configured to seal said second opening when pressed together;

a straw defining a passageway into said volume, said straw further comprising an attachment to said container wall.

20. Said container of claim 19 wherein said container:

reversibly occupies a collapsed configuration defining a first volume and an expanded configuration defining a second volume;

further contains a fold line that extends in an axial direction on at least a part of said container wall for permitting said container to collapse in a generally radial direction and;

wherein said second volume is greater than said first volume.

* * * * *